US008920533B2

(12) United States Patent
Bishop et al.

(10) Patent No.: US 8,920,533 B2
(45) Date of Patent: Dec. 30, 2014

(54) ALUMINUM ALLOY POWDER METAL BULK CHEMISTRY FORMULATION

(75) Inventors: Donald Paul Bishop, Stillwater Lake (CA); Christopher D. Boland, Halifax (CA); Richard L. Hexemer, Jr., Granite Falls, NC (US); Ian W. Donaldson, Jefferson, MA (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 882 days.

(21) Appl. No.: 13/062,869

(22) PCT Filed: Oct. 6, 2009

(86) PCT No.: PCT/US2009/059675

§ 371 (c)(1),
(2), (4) Date: Mar. 8, 2011

(87) PCT Pub. No.: WO2010/042498

PCT Pub. Date: Apr. 15, 2010

(65) Prior Publication Data

US 2011/0265757 A1 Nov. 3, 2011

Related U.S. Application Data

(60) Provisional application No. 61/104,572, filed on Oct. 10, 2008.

(51) Int. Cl.

| | |
|---|---|
| ***B22F 3/12*** | (2006.01) |
| ***C22C 1/04*** | (2006.01) |
| ***B22F 3/24*** | (2006.01) |
| ***B22F 3/16*** | (2006.01) |

(52) U.S. Cl.

CPC ... *B22F 3/12* (2013.01); *B22F 3/24* (2013.01); *B22F 3/162* (2013.01); *C22C 1/0416* (2013.01); *C22C 1/0491* (2013.01)

USPC ..... 75/249; 75/252; 419/28; 419/32; 419/38

(58) Field of Classification Search

CPC ..... C22C 1/0416; C22C 1/0491

USPC ..... 75/255

See application file for complete search history.

(56) References Cited

U.S. PATENT DOCUMENTS

| | | | | |
|---|---|---|---|---|
| 3,301,671 | A * | 1/1967 | Storchheim | 419/47 |
| 3,366,479 | A * | 1/1968 | Storchheim et al. | 419/36 |
| 3,687,657 | A * | 8/1972 | Storchheim | 419/32 |
| 3,792,997 | A * | 2/1974 | Storchheim | 75/255 |
| 4,336,075 | A | 6/1982 | Quist et al. | |
| 4,629,505 | A * | 12/1986 | Paris | 75/228 |
| 5,273,594 | A | 12/1993 | Cassada, III | |
| 5,593,516 | A | 1/1997 | Cassada, III | |
| 5,902,943 | A | 5/1999 | Schaffer et al. | |
| 6,355,207 | B1 | 3/2002 | Keyes | |
| 6,468,468 | B1 | 10/2002 | Neubing et al. | |
| 7,036,550 | B2 | 5/2006 | Schaffer et al. | |
| 7,294,213 | B2 | 11/2007 | Warner et al. | |
| 2007/0158003 | A1 | 7/2007 | Tokuoka et al. | |
| 2007/0187006 | A1 | 8/2007 | Chung et al. | |

FOREIGN PATENT DOCUMENTS

| | | | |
|---|---|---|---|
| JP | S5096409 | A | 7/1975 |
| JP | S56123347 | A | 9/1981 |
| JP | H11140578 | A | 5/1999 |
| JP | 2003231956 | A | 8/2003 |

OTHER PUBLICATIONS

International Search Report and Written Opinion under date of Dec. 3, 2009 in connection with PCT/US2009/059675.

The effect of the atmosphere and the role of pore filling on the sintering of alumnimum, G.B. Schaffer et al; Acta Materialia 54 (2006) 131-138.

Microsegration Phenomena in Al—Cu—Mg Alloy With Considering of Diffusion Phenomena in Primary Phase, Igor Vusanovic, et al.; Mechanical Engineering vol. 1, No. 8, 2001, pp. 965-980.

Precipitates and intermetallic phases in precipitation hardening Al—Cu—Mg—(Li) based alloys, S.G. Wang, et al.; Inter. Maer Rev., 2005, vol. 50, pp. 193-215.

Japanese Patent Office, Notification of Reasons for Refusal, Application No. 2011-531112, Feb. 7, 2014, 8 pages.

* cited by examiner

*Primary Examiner* — George Wyszomierski
*Assistant Examiner* — Ngoclan T Mai
(74) *Attorney, Agent, or Firm* — Quarles & Brady LLP

(57) ABSTRACT

A powder metal mixture is disclosed that provides improved mechanical properties for parts made from powder metal, such as cam caps. The powder metal mixture, upon sintering, forms an S phase intermetallic in the Al—Cu—Mg alloy system. The S phase is present in a concentration that results in an enhanced response to cold work strengthening of the powder metal part. Further, by minor adjustments to certain alloy elements, such as tin, the tensile properties of the resultant part may be adjusted.

22 Claims, 7 Drawing Sheets

ALUMINUM ALLOY POWDER METAL BULK CHEMISTRY FORMULATION

CROSS-REFERENCE TO RELATED APPLICATIONS

This application claims priority to U.S. provisional patent application Ser. No. 61/104,572 titled "ALUMINUM ALLOY POWDER METAL BULK CHEMISTRY FORMULATION" and filed on Oct. 10, 2008. The full contents of that application is incorporated by reference as if set forth in its entirety herein.

STATEMENT OF FEDERALLY SPONSORED RESEARCH OR DEVELOPMENT

Not applicable.

TECHNICAL FIELD

The invention relates to powder metal parts. In particular, this invention relates to an aluminum alloy powder metal bulk chemistry formulation for powder metal parts, specifically in the example given, for camshaft bearing caps.

BACKGROUND OF THE INVENTION

Camshaft bearing caps or "cam caps" are conventionally used to secure a camshaft bearing assembly to an engine block. Cam caps come in various shapes, but typically include a portion of an arch with bolt holes on both sides. The camshaft bearing assembly is held in place in the engine by the arch of the cam cap when the cam cap is secured to the block by fastening bolts through the bolt holes of the cam cap to the block. As the camshaft rotates to engage the valve train, the cam caps must be able to withstand cyclic loading. It has become more common to form various engine components, including cam caps, from aluminum alloys because many aluminum alloys have excellent strength to weight ratios.

Many of these aluminum cam caps have been formed by die casting in the past. However, because the cam caps must provide a precision fit around the camshaft bearings when bolted to the block, many of the dimensions for cam caps have tight tolerances. Because die cast cam caps do not have the needed dimensional precision after casting, die cast cam caps must be subsequently machined. Machining the cam cap adds time and cost to the production of the cam cap. Further, some cam caps may have fine levels of detail, such as oil passageways, which are not easily formed by die casting.

To avoid many of these problems and to provide a cam cap that is more dimensionally accurate prior to machining, some aluminum cam caps are fabricated using powder metal processing. However, because cam caps fabricated by powder metal processing have higher levels of porosity when compared to die cast cam caps (which are typically fully dense), powder metal cam caps often have somewhat compromised mechanical properties in comparison to die cast cam caps.

Hence, there is a need for powder metal parts, such as cam caps, that have improved mechanical properties.

SUMMARY OF THE INVENTION

A powder metal mixture is disclosed that provides improved mechanical properties for parts made from powder metal, such as cam caps. The powder metal mixture, upon sintering, forms an S phase intermetallic in the Al—Cu—Mg alloy system. The S phase is present in a concentration that results in an enhanced response to cold work strengthening of the powder metal part. Further, by minor adjustments to certain alloy elements, such as tin, the tensile properties of the resultant part may be adjusted.

The foregoing and advantages of the invention will appear in the detailed description which follows. In the description, reference is made to the accompanying drawings which illustrate preferred embodiments of the invention.

DETAILED DESCRIPTION OF THE PREFERRED EMBODIMENTS

According to one aspect of the present invention, a powder metal mixture is provided for production of a powder metal part such as a cam cap. This powder metal mixture includes air atomized aluminum powder, an aluminum-copper (50/50) master alloy, and atomized magnesium powder. The air atomized aluminum powder and the aluminum-copper (50/50) master alloy powders can be obtained from Ecka Granules and the atomized magnesium powder can be obtained from Tangshan Weihao Magnesium Powder Company. These three powder metals, along with 1.5% weight percent P/M-grade Licowax® C (available from Clariant®) are be prepared using Turbala blending or other blending methods to mix the powders.

Figure 1A:
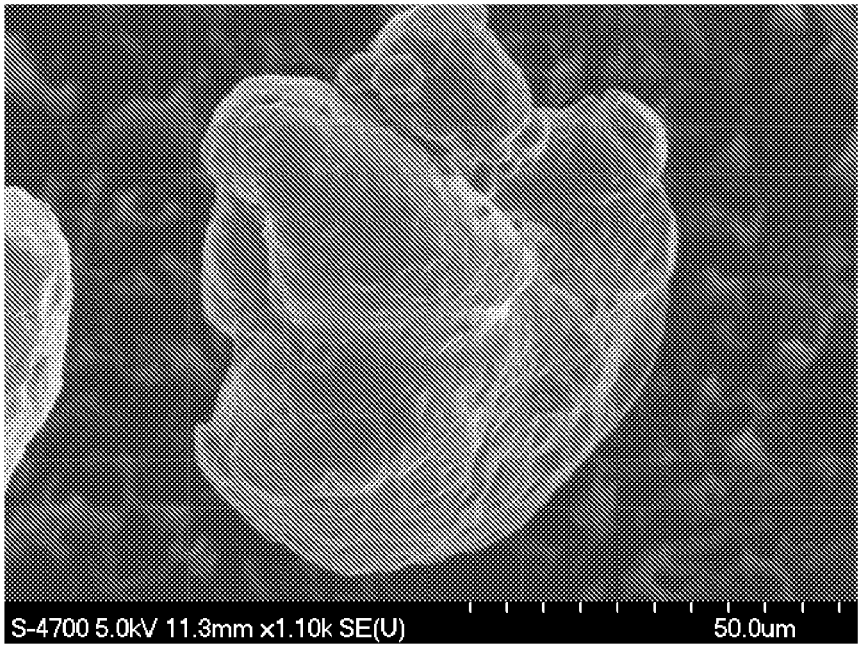
FIG. 1A shows an image of an air atomized aluminum powder taken in an electron microscope.
Figure 1B:
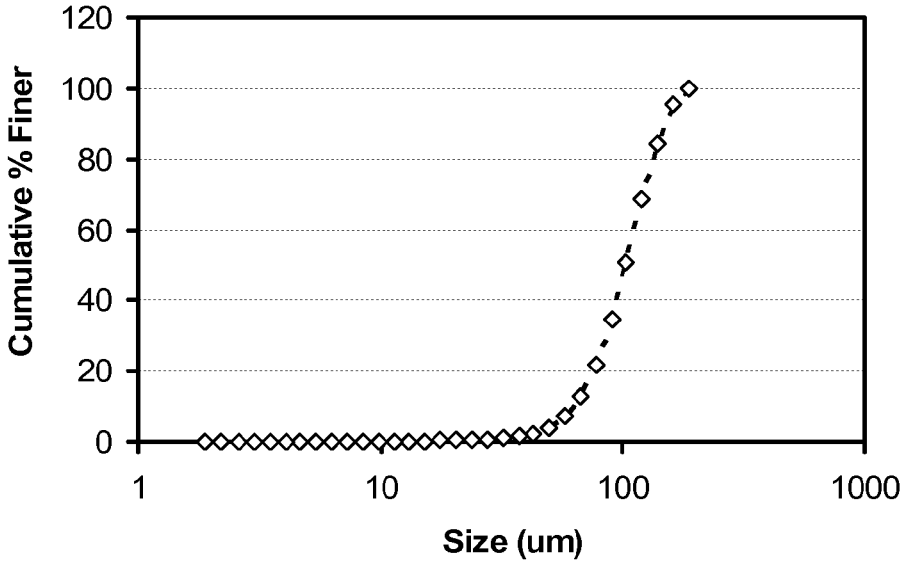
FIG. 1B is a chart showing a particle size distribution of the air atomized aluminum powder of FIG. 1A.
Figure 2A:
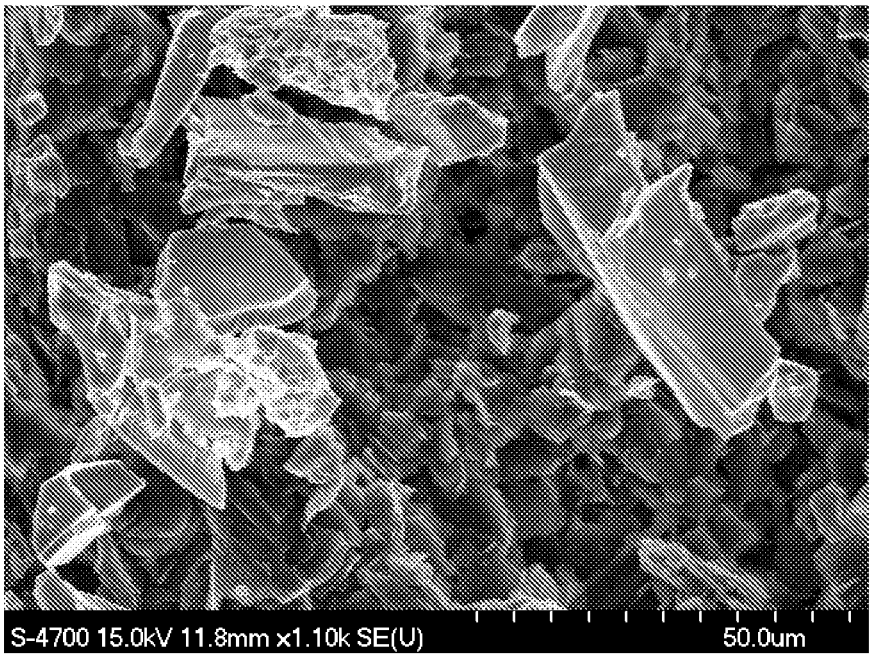
FIG. 2A shows an image of an aluminum-copper (50/50) master alloy powder taken in an electron microscope.
Figure 2B:
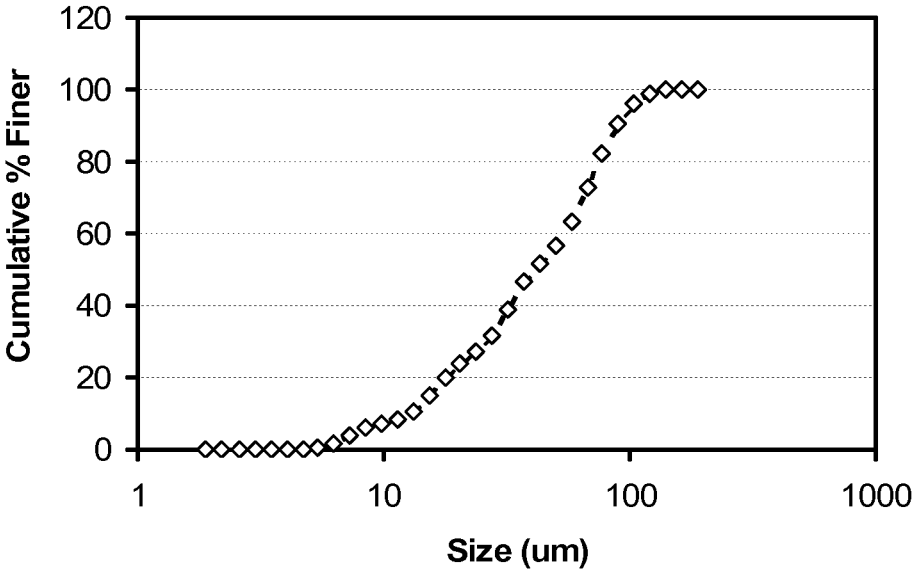
FIG. 2B is a chart showing a particle size distribution of the aluminum-copper (50/50) master alloy powder of FIG. 2A.
Figure 3A:
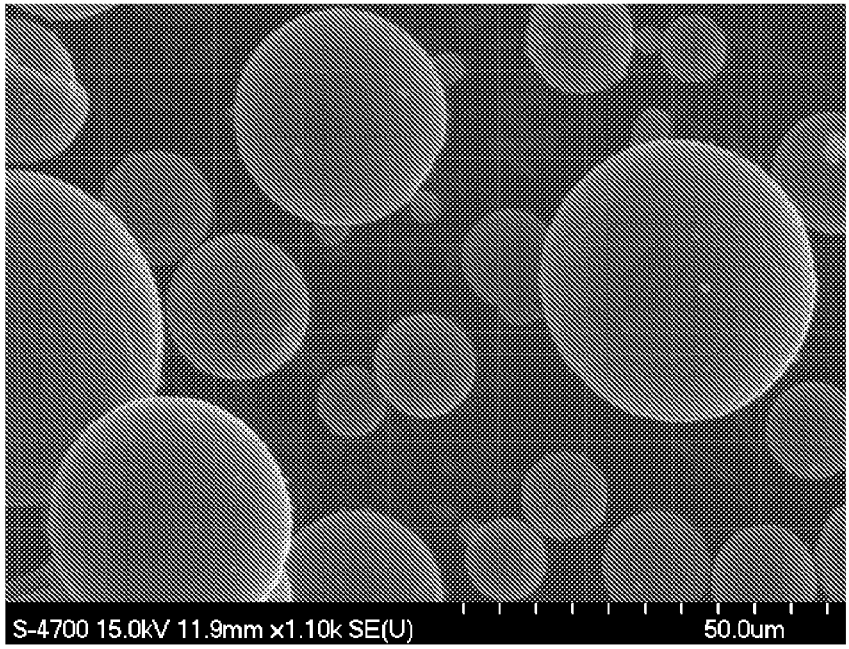
FIG. 3A shows an image of an atomized magnesium powder taken in an electron microscope.
Figure 3B:
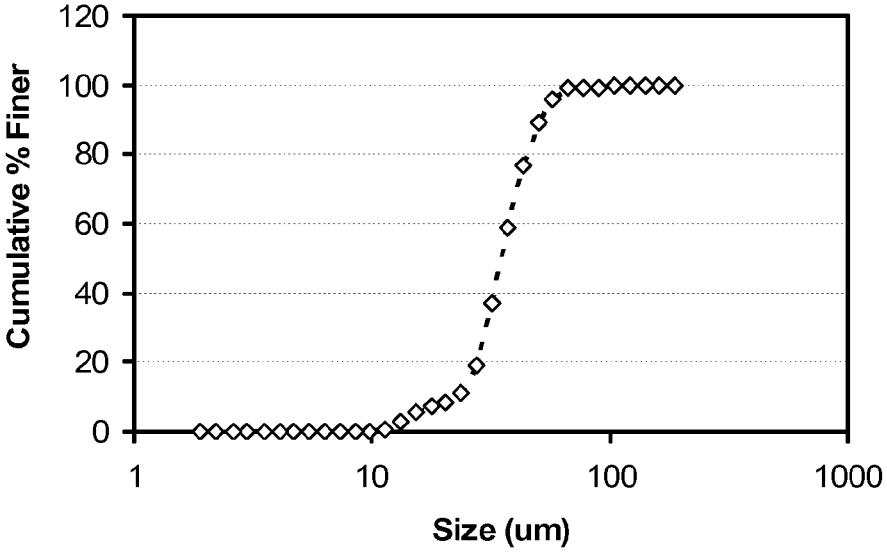
FIG. 3B is a chart showing a particle size distribution of the atomized magnesium powder of FIG. 3A.

FIGS. 1A-3B characterize the morphology and particle size distribution of each of these powders prior to mixing. FIGS. 1A, 2A, and 3A show images taken in an electron microscope of the air atomized aluminum powder, the aluminum-copper (50/50) master alloy powder, and the magnesium powder respectively. Notably, the shape of the particles of the air atomized aluminum powder and the atomized magnesium powder are generally round, with the magnesium powder being essentially spherical. On the other hand, the shape of the particles of the aluminum-copper (50/50) master alloy is much more varied and irregular. FIGS. 1B, 2B, and 3B show the cumulative percent of each of the powders that is finer than a particular particle size (in micrometers). Again, FIGS. 1B, 2B, and 3B, showing the particle size distribution, correspond to the air atomized aluminum powder, the aluminum-copper (50/50) master alloy, and the atomized magnesium powder respectively. Notably, the x-axis, representing the particle size is on a logarithmic scale. To better characterize the powders, a summary comparison of the particle size data for the powders is provided in Table I below at the 10, 50 and 90 cumulative % finer levels.

TABLE I

| POWDER | $D_{10}$ (μm) | $D_{50}$ (μm) | $D_{90}$ (μm) |
|---|---|---|---|
| Atomized Aluminum | 63 | 104 | 150 |
| Al—Cu Master Alloy | 13 | 41 | 89 |
| Atomized Magnesium | 23 | 35 | 51 |

The powders are preferably mixed to form a powder metal part having a Al-4.4Cu-1.5Mg general bulk composition by weight percent. As used herein, the Al-4.4Cu-1.5Mg mixture will be referred to as "Dal-2324". Although an aluminum alloy having 4.4 wt % copper and 1.5 wt % magnesium with minimal inclusion of other alloying elements is preferred, alloying elements and other impurities may have a bulk chemistry within the ranges shown in Table II below.

TABLE II

| ELEMENTS | MIN. | MAX. |
|---|---|---|
| Aluminum (Al) | Balance | |
| Chromium (Cr) | — | 0.20% |
| Copper (Cu) | 3.0% | 5.0% |
| Iron (Fe) | — | 0.30% |
| Magnesium (Mg) | 1.0% | 2.0% |
| Manganese (Mn) | — | 1.0% |
| Silicon (Si) | — | 0.15% |
| Titanium (Ti) | — | 0.15% |
| Zinc (Zn) | — | 0.30% |
| Nickel (Ni) | — | 2.50% |
| Tin (Sn) | — | 1.2% |
| Other, each | — | 0.100% |
| Other, total | — | 0.20% |

The powder metal mixture has a simple chemistry. Notably, no silicon addition is needed. Further, there are minimal iron impurities.

The Dal-2324 powder metal mixture has a flow rate and an apparent density that is comparable to commercial powders available for making cam caps as can be seen in Table III. When compared to Alumix 123 (manufactured by Ecka Granules) and AMB 2712A (manufactured by Ampal, Inc.), the Dal-2324 has a nearly equivalent flow rate and apparent density in powder form.

TABLE III

| ALLOY | FLOW RATE (s) | APPARENT DENSITY (g/cc) |
|---|---|---|
| Alumix 123 | 9 | 1.176 |
| AMB 2712A | 9 | 1.289 |
| Dal-2324 | 8 | 1.206 |

The Dal-2324 powder metal mixture is formed into a cam cap using conventional powder metal processing. The air atomized aluminum powder, the aluminum-copper (50/50) master alloy powder, the atomized magnesium powder, and a binder/lubricant are mixed together to form the powder metal mixture. This powder metal mixture is then filled into a compaction form such as a die cavity having upper and lower rams, punches, and/or core rods. The powder metal mixture is compacted at a compaction pressure to form a "green" preform. The green preform is then sintered for a length of time at a sintering temperature that is just below the liquidus temperature of the powder metal mixture to form the sintered part. As the green preform is sintered, the binder/lubricant are boiled off and the particles of the preform neck into one another via diffusion. During this process, the pores between the particles reduce in size and are often closed. As the porosity of the part decreases, the density of the part rises and the part "shrinks" dimensionally. Other phenomena may also play a role in the densification of the part. For example, during liquid phase sintering, capillary action may play a more dominant role in determining the rate at which the pores are filed and the part is densified.

In most sintered parts, the mechanical properties of the sintered part are largely dependent on the density of the part. If the part has a high density (close to or approaching full density), that usually means the part will have, for example, increased apparent hardness and tensile strength. Density could be further increased by slightly increasing the temperature (while still keeping it below the liquidus point) or increasing the sintering time-at-temperature. However, for most powder metal powder compositions, it is thermodynamically and kinetically difficult to obtain a density that approaches full density. As the pores close, the mechanism for reducing porosity changes from necking of the particles together to vacancy diffusion through the part. When the diffusion of vacancies from the pores to the outer surface of the part become the predominant mechanism for densification, only marginal increases in density can be obtained by increasing the sintering time and/or temperature. Further, keeping parts at sintering temperatures for a longer time can have undesirable effects on the dimensions of the part. If the part is subjected to a heat gradient or high temperatures for too long, it could shrink more in some areas than in others. As a result, the part would be less dimensionally accurate.

However, it has been found that the powder metal mixture described above has an improved sinter response. Thus, with similar heat treatment to other commercially available powders (Alumix 123 and AMB 2712A), the Dal-2324 powder metal mixture obtains a higher density. This increase in sintered density, along with the formation of a unique intermetallic phase, has been found to strengthen the part relative to comparable powders for production of cam caps.

Figure 4A:
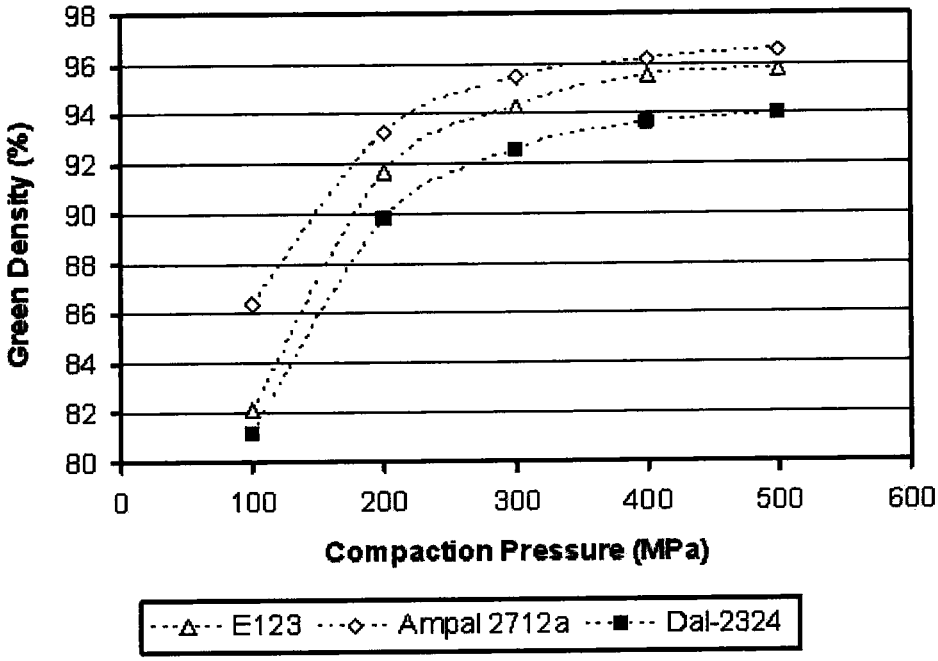
FIG. 4A shows a chart comparing the green density of various powder metal compositions at various compaction pressures.
Figure 4B:
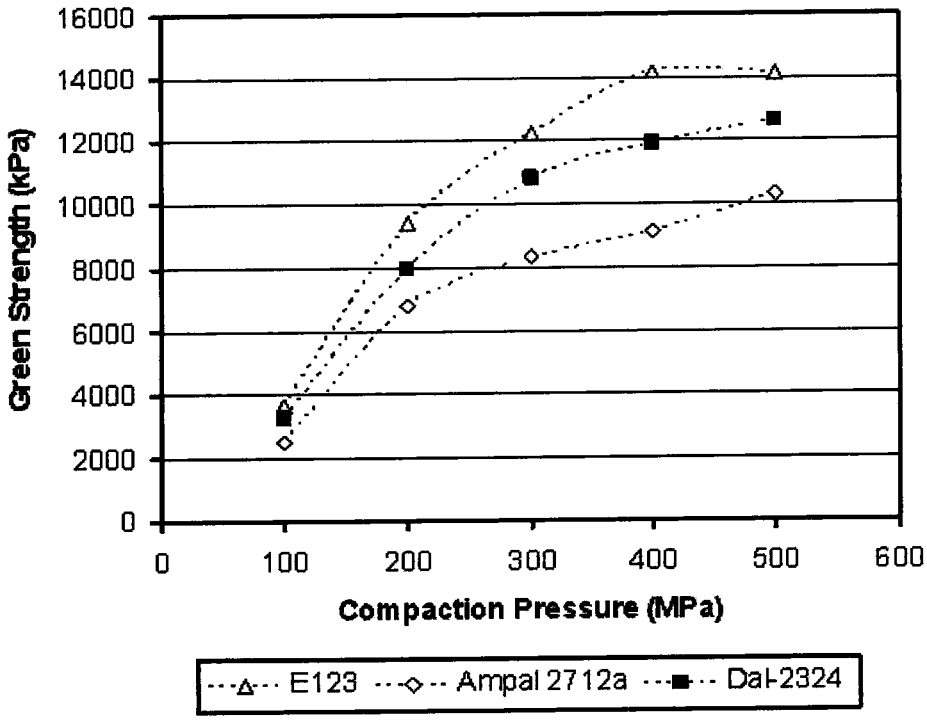
FIG. 4B shows a chart comparing the green strength of various powder metal compositions at various compaction pressures.

Referring now to FIGS. 4A and 4B, the green density and green strength of preforms made from Alumix 123 (denoted as "E123"), AMB 2712A (denoted as "Ampal 2712a"), and Dal-2324 at various compaction pressures (in MPa) are shown.

As best seen in FIG. 4A, the Dal-2324 powder is approximately 81% dense at 100 MPa compaction pressure, 90% dense at 200 MPa, 92.5% dense at 300 MPa, and 93.5% dense at 400 MPa, and 94% dense at 500 MPa. At the higher compaction pressures, the marginal increase in green density diminishes as a result of an increase in compaction pressure. Given the increased stresses on the tools and the diminishing green density at increased compaction pressure, even higher compaction pressures would be uncommon. The Dal-2324 powder has a green density that is typically 1-4% less than the Alumix 123 and AMB 2712A powders at a given compaction pressure. The difference in green density percent between the Dal-2324 powder and the Alumix 123 and AMB 2712A powders slightly decreases as the compaction pressure increase.

Referring now to FIG. 4B, despite having a lower green density than the parts made from the Alumix 123 and the AMB 2712A powders at a given compaction pressure, the parts made from the Dal-2324 powder have a green strength that is comparable to the other two powders. At 100 MPa compaction pressure, the Dal-2324 powder has a green strength of just over 3000 kPa, a green strength of 8000 kPa at 200 MPa compaction pressure, a green strength of just less than 11000 kPa at 300 MPa compaction pressure, a green strength of 12000 kPa at 400 MPa compaction pressure, and a green strength of approximately 12500 kPa at 500 MPa compaction pressure. These green strengths exceed the green strengths of the AMB 2712A powder at a given compaction pressure, but are less than the green strength of the Alumix 123 powder at a given compaction pressure.

Figure 5A:
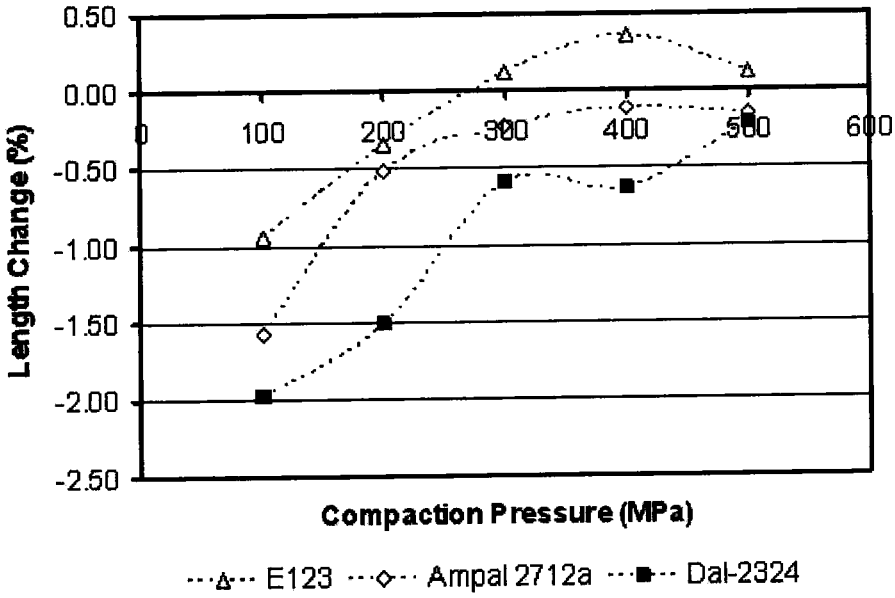
FIG. 5A-5C show charts comparing the dimensional changes of various powder metal compositions at various compaction pressures.
Figure 5B:
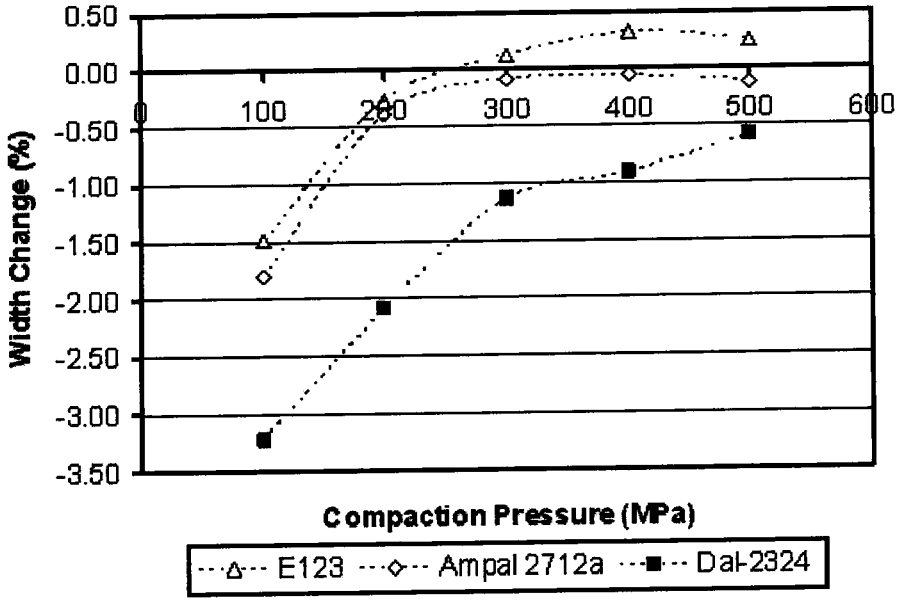
Figure 5C:
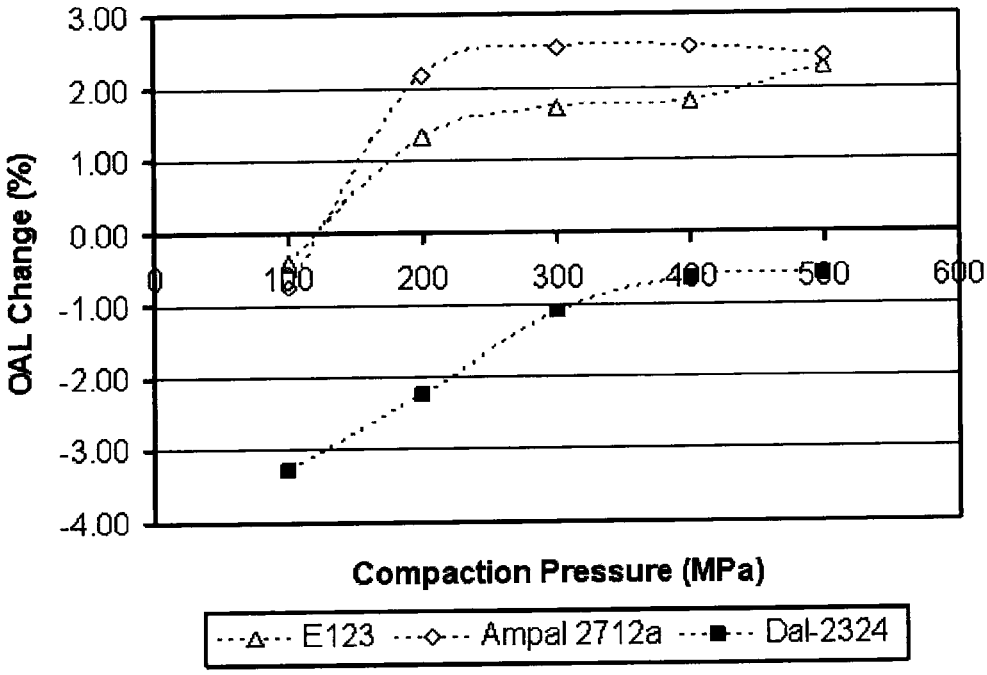

Referring now to FIGS. 5A-5C, the Dal-2324 powder has heightened shrinkage during sintering. The charts of FIGS. 5A-5C compare the length, width, and overall length (OAL) changes for each of the powders at a given compaction pressure. At a given compaction pressure, the parts made from the Dal-2324 powder shrink more than the parts made from the AMB 2712A powder and the Alumix 123 powder. The amount of shrinkage in a given dimension generally decreases as the compaction pressure, and hence green density, increases. This in and of itself should not be surprising as the Dal-2324 preforms have a lower green density than the Alumix 123 and AMB 2712A preforms, giving the Dal-2324 preforms more room to initially shrink during sintering.

Figure 6:
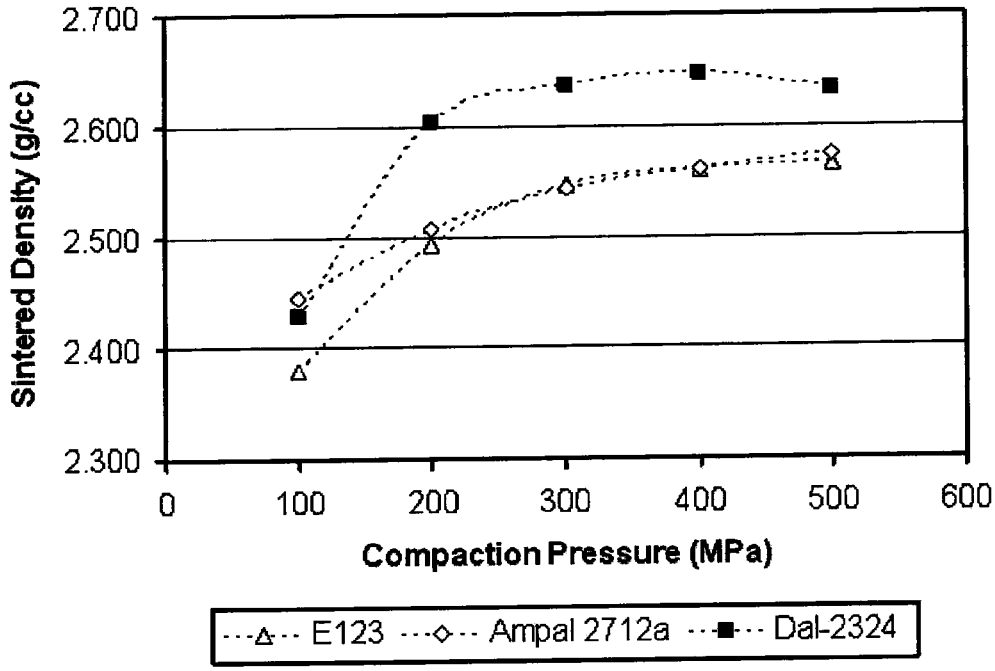
FIG. 6 shows a chart comparing the sintered density of various powder metal compositions at various compaction pressures.

However, referring now to FIG. 6, it is shown that for most of the compaction pressures, and especially the greater compaction pressures, the sintered density of the Dal-2324 powders greatly exceeds the two other commercially available powders. At 200 MPa compaction pressure, the Dal-2324 has a sintered density of just above 2.6 g/cc, at 300 MPa compaction pressure, the Dal-2324 has a sintered density of just above 2.63 g/cc, at 400 MPa compaction pressure, the Dal-2324 has a sintered density of approximately 2.65 g/cc, and at 500 MPa compaction pressure, the Dal-2324 has a sintered density of just under 2.64 g/cc. At compaction pressures above 200 MPa, the sintered density of the Dal-2324 exceeds the sintered density of the two other commercially available powders by between 0.1 g/cc and 0.05 g/cc. This increase in sintered density, coupled with the intermetallic phase formed by this unique combination of powders, results in the improved mechanical properties listed below.

Table IV lists the mechanical properties of some of the samples that were prepared without any substantial amount of tin in the alloy.

To understand the difference in mechanical properties, it is helpful to understand the microscopic behavior of the Dal-2324 components and how it differs from the standard powder metal alloys. Most high performance aluminum alloys are strengthened by a dispersion of fine intermetallics formed through appropriate heat treatment procedures. The type of intermetallic(s) formed is, at least in part, a function of the bulk chemistry of the material. For example in Alumix 123 or Ampal 2712A, there is a high ratio of copper to magnesium (usually in the range of 8-9:1). In these conditions, the dominant strengthening intermetallic phase is the θ phase ($CuAl_2$) and metastable variants thereof.

The Al-4.4Cu-1.5Mg composition, by means of bulk chemistry and morphology of the powder metals in the mixture, is tweaked to promote the formation of an intermetallic S phase ($CuMgAl_2$) and metastable variants thereof. The S phase intermetallic exhibits a more potent strengthening effect in cold worked aluminum alloys than does the θ phase. It is harder for dislocations to pass the S phase intermetallic than the θ phase intermetallic and, as a result, the alloy having the S phase intermetallic is harder and exhibits improved tensile properties. It is contemplated that this powder metal mixture may be even more beneficial after being subjected to cold working operations as are common in a "press-sinter-size"-type production sequence.

Minor adjustments may be made to the raw power blend to achieve the same or substantially similar result having formation of the S phase intermetallic. For example, the aluminum copper master alloy powder could have a composition other than 50/50 by weight percent. Further, minor adjustments could be made to the quantities of the powders mixed to control the amount of each alloying element in the bulk chemistry within the ranges shown in Table II, sometimes with an additional advantage.

Figure 7:
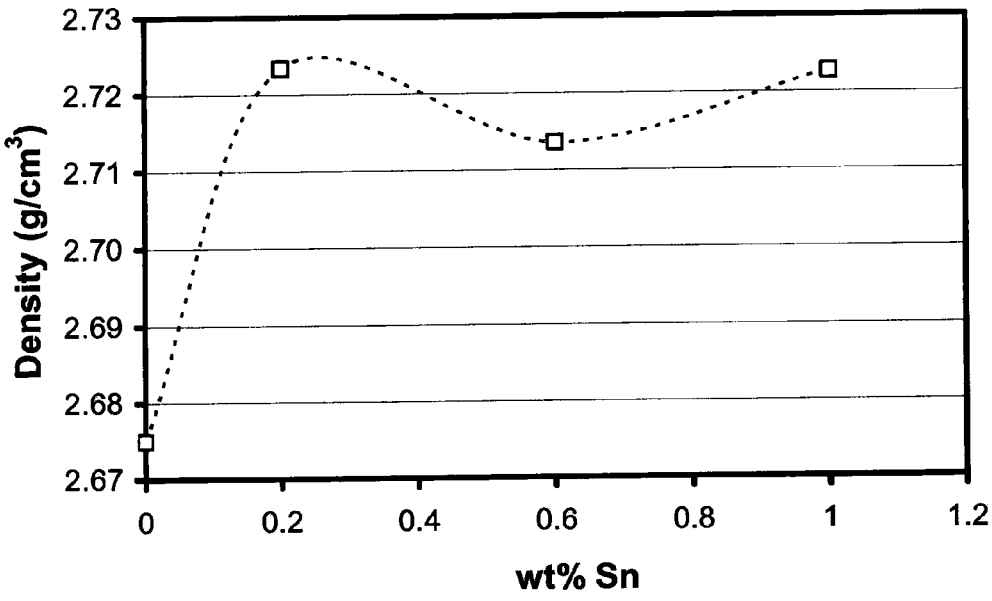
FIG. 7 is a graph illustrating the effect of tin additions on sintered density of a powder metal part made from the Dal-2324 alloy.
Figure 8:
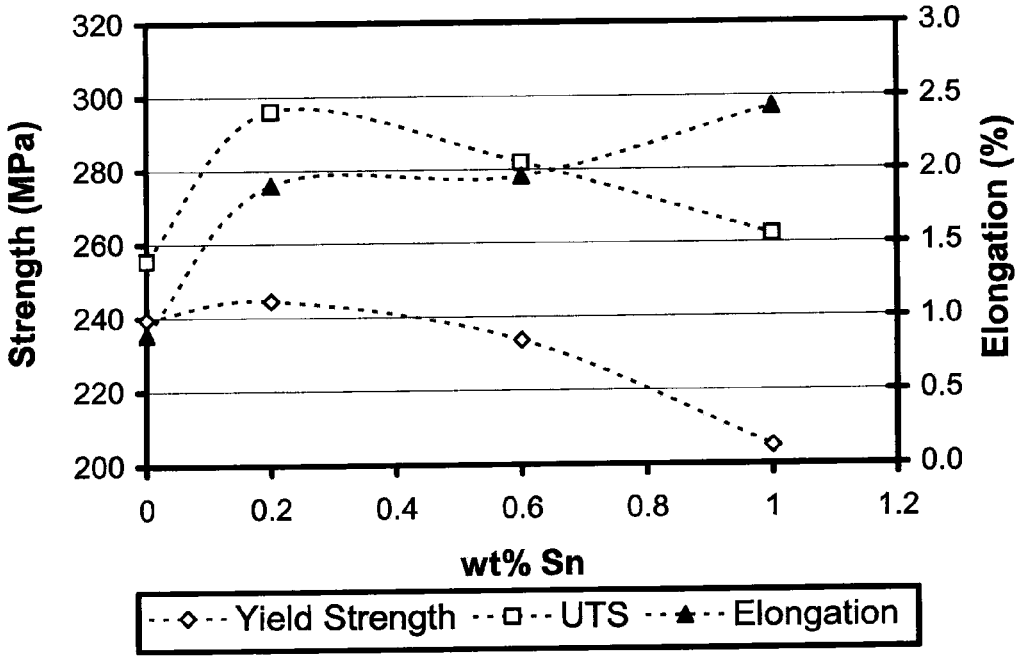
FIG. 8 is a graph illustrating the effect of tin additions on the mechanical properties of the Dal-2324 alloy.

Tin is one such example of an alloying element that may be adjusted to change the microstructure, phase development, and mechanical and chemical properties of the alloy up to a small percentage, for example up to 1.2 wt % Sn. Referring now to FIGS. 7 and 8, two graphs are provided which illustrate the effect of tin additions of up to 1.0 wt % on the sintered density and on various mechanical properties, respectively, of the Dal-2324 alloy. One observation that may be made from these graphs is that for tin additions up to approximately 0.2 wt %, the sintered density and the tensile properties will increase. As seen in FIG. 8, at approximately 0.2 wt %, the Dal-2324 alloy has an ultimate tensile strength (UTS) of approximately 295 MPa and a yield strength of approximately 245 MPa.

TABLE IV

| ALLOY | COMPACTION PRESSURE (MPa) | YIELD (MPa) | UTS (MPa) | YOUNG'S MOD. (GPa) | ELONGATION (%) | HARDNESS (HRE) |
|---|---|---|---|---|---|---|
| Alumix | 200 MPa | 129 | 158 | 51.0 | 1.5 | 58.2 |
| 123 | 300 MPa | 134 | 173 | 53.6 | 2.0 | 64.1 |
| | 500 MPa | 136 | 171 | 53.7 | 1.6 | 65.9 |
| Dal-2324 | 200 MPa | 185 | 194 | 58.9 | 0.7 | 74.5 |
| | 300 MPa | 208 | 222 | 66.7 | 0.7 | 80.2 |
| | 400 MPa | 204 | 223 | 61.9 | 0.9 | 82.0 |

Notably, the parts made from Dal-2324 exhibit greater yield strength, ultimate tensile strength (UTS) and hardness over the parts made from Alumix 123. The Dal-2324 powder provides gains of 30-50% in apparent hardness and tensile strength compared to standard AC2014-type powder metal alloys in use today.

However, at about or after approximately 0.2 wt % of tin, additional amounts of tin in the Dal-2324 alloy begin to have a different effect. Above approximately 0.2 wt %, the addition of more tin causes the ultimate tensile strength (UTS) and yield strength to decrease, although the percent elongation continues to rise. This change in the trend is believed to be a result of tin additions above approximately 0.2 wt % suppressing the formation of the S phase intermetallic. This helps to illustrate the benefit of the presence of the S phase in increasing the hardness of the sintered alloy as a comparison between 0 wt % tin and 1.0 wt % tin show that despite having similar ultimate tensile strengths, at 1.0 wt % tin the yield strength is approximately 30 MPa less than the yield strength at 0.0 wt % tin.

It is also contemplated that ceramic or intermetallic reinforcement could be added to the powder metal. Such reinforcement could include, but are not limited to, $Al_2O_3$, SiC and AlN. As these reinforcements are stable at sintering temperatures for the aluminum alloy, they could be included in the powder metal mixture so that they are evenly dispersed throughout the bulk of the part after sintering. This reinforcement could be added up to 15% by volume in the part. Such reinforcement would increase the modulus, wear resistance, and strength of the material. For example, in one set of samples comprising Dal-2324 powder plus 5 vol % SiC, measureable improvements in were found in a number of properties of the resultant material. Around ten percent gains in the yield strength, the ultimate tensile strength, and the Young's modulus were observed in the parts including 5 vol % SiC reinforcement.

While there have been shown and described what is at present considered the preferred embodiments of the invention, it will be obvious to those skilled in the art that various changes and modifications can be made therein without departing from the scope of the invention defined by the appended claims.

What is claimed is:

1. A powder metal part comprising a body formed of a powder metal material, the powder metal material comprising a powder metal mixture of an atomized aluminum powder, an aluminum-copper master alloy powder, and an atomized magnesium powder that are compacted and sintered to form intermetallic S-type phases ($CuMgAl_2$) in the body in a concentration that results in an enhanced response to cold work strengthening of the powder metal part.

2. The powder metal part of claim 1 wherein, after sintering, the powder metal part consists essentially of 4.4 weight percent copper and 1.5 weight percent magnesium with the remainder of the powder metal part being substantially aluminum.

3. The powder metal part of claim 1 wherein the powder metal mixture exhibits a heightened sinter response over standard PM alloys of the AC2014-type.

4. The powder metal part of claim 1 wherein the powder metal mixture exhibits an improved apparent hardness over standard PM alloys of the AC2014-type.

5. The powder metal part of claim 1 wherein the powder metal mixture exhibits an improved tensile strength over standard PM alloys of the AC2014-type.

6. The powder metal part of claim 1 wherein the powder metal part is a cam cap for an engine camshaft.

7. The powder metal part of claim 1 wherein the powder metal mixture includes tin in a weight percent that does not inhibit the formation of the intermetallic S-type phases.

8. The powder metal part of claim 1 wherein the hardness of the powder metal part exceeds 70 HRE.

9. The powder metal part of claim 1 wherein a sintered density of the powder metal part exceeds 2.6 g/cm$^3$.

10. The powder metal part of claim 1 wherein the atomized aluminum powder is air atomized.

11. The powder metal part of claim 1 wherein the aluminum-copper master alloy powder is a 50 percent by weight aluminum and 50 percent by weight copper.

12. A method of making a powder metal part comprising:

mixing an atomized aluminum powder, an aluminum-copper master alloy powder, and an atomized magnesium powder to form a powder metal mixture;

filling a compaction form with the powder metal mixture;

compacting the powder metal mixture in the compaction form into a preform; and sintering the preform to form the powder metal part having an intermetallic S phase ($CuMg\ Al_2$) in a concentration that results in an enhanced response to cold work strengthening of the powder metal part.

13. The method of claim 12 further comprising the step of cold working the powder metal part.

14. The method of claim 12 wherein the powder metal part is a cam cap for an engine camshaft.

15. The method of claim 12 wherein, after sintering, the powder metal part consists essentially of 4.4 weight percent copper and 1.5 weight percent magnesium with the remainder of the powder metal part being aluminum.

16. A powder metal mixture comprising:

an atomized aluminum powder;

an aluminum-copper master alloy powder;

a atomized magnesium powder; and wherein the powders are mixed to form the powder metal mixture that upon compaction and sintering provide a powder metal part having an intermetallic S phase ($CuMgAl_2$) in a concentration that results in an enhanced response to cold work strengthening of the powder metal part.

17. The powder metal mixture of claim 16 further wherein the atomized aluminum powder is air atomized and the aluminum-copper master alloy is 50 percent by weight aluminum and 50 percent by weight copper.

18. The powder metal mixture of claim 16 wherein, after sintering, the powder metal part consists essentially of 4.4 weight percent copper and 1.5 weight percent magnesium with the remainder of the powder metal part being aluminum.

19. The powder metal mixture of claim 16 wherein the powder metal mixture exhibits a heightened sinter response over standard PM alloys of the AC2014-type.

20. The powder metal mixture of claim 16 wherein the powder metal mixture exhibits an improved apparent hardness over standard PM alloys of the AC2014-type.

21. The powder metal mixture of claim 16 wherein the powder metal mixture exhibits an improved tensile strength over standard PM alloys of the AC2014-type.

22. The powder metal mixture of claim 16 further comprising tin in a weight percent that does not inhibit the formation of the intermetallic S phase.

* * * * *